United States Patent [19]

Chang et al.

[11] Patent Number: 4,661,156

[45] Date of Patent: Apr. 28, 1987

[54] NICKEL ALUMINIDE BASE COMPOSITIONS CONSOLIDATED FROM POWDER

[75] Inventors: Keh-Minn Chang; Alan I. Taub, both of Schenectady; Shyh-Chin Huang, Latham, all of N.Y.

[73] Assignee: General Electric Company, Schenectady, N.Y.

[21] Appl. No.: 783,718

[22] Filed: Oct. 3, 1985

[51] Int. Cl.[4] ..... B22F 3/00

[52] U.S. Cl. ..... 75/246; 75/0.5 BA; 75/0.5 C; 75/82; 148/11.5 A; 148/11.5 N; 148/11.5 P; 148/126.1; 148/429; 419/49; 419/66; 419/68; 420/460; 420/590

[58] Field of Search ..... 420/459, 460, 590; 75/244, 246, 249, 0.5 C, 82, 0.5 BA; 419/30, 38, 49, 62, 66, 68; 148/11.5 A, 11.5 N, 11.5 P, 126.1, 133, 429

[56] References Cited

U.S. PATENT DOCUMENTS 4,212,669 7/1980 Veeck et al. ..... 419/49
4,500,364 2/1985 Krutenat ..... 419/47

OTHER PUBLICATIONS

C. T. Liu & C. C. Koch, "Development of Ductile Polycrystalline $Ni_3Al$ for High-Temperature Applications", Technical Aspects of Critical Materials Use by the Steel Industry, NBSIR 83-2679-2, vol. IIB (Jun. 1983), Center for Materials Science, U.S. Dept. of Commerce, Nat'l. Bureau of Standards.

*Primary Examiner*—Stephen J. Lechert, Jr.
*Attorney, Agent, or Firm*—Paul E. Rochford; James C. Davis, Jr.; Paul R. Webb, II

[57] ABSTRACT

A metal body having high tensile strength and ductility at temperatures over 1000° F. is provided. The body is prepared by hot isostatic pressing of powder formed by atomization of a melt of an alloy. The alloy composition base is according to the formula:

$$(Ni_{1-x}Al_x)_{100-y}B_y$$

where x is between 0.23 and 0.25, and where y is 0.1 to 2.0.

The consolidated body is suitable for machining and may be annealed for a couple of hours at temperatures between 800° C. and 1200° C. following such machining.

8 Claims, 2 Drawing Figures

ROOM TEMPERATURE TENSILE AND DUCTILITY PROPERTIES

ROOM TEMPERATURE TENSILE AND DUCTILITY PROPERTIES

NICKEL ALUMINIDE BASE COMPOSITIONS CONSOLIDATED FROM POWDER

BACKGROUND OF THE INVENTION

The present invention relates generally to compositions having a tri-nickel aluminide base. More specifically, it relates to aluminide base compositions which may be consolidated into useful articles.

It is known that polycrystalline tri-nickel aluminide castings exhibit properties of extreme brittleness, low strength and poor ductility at room temperature.

The single crystal tri-nickel aluminide in certain orientations does display a favorable combination of properties at room temperature including significant ductility. However, the polycrystalline material which is conventionally formed by known processes does not display the desirable properties of the single crystal material and, although potentially useful as a high temperature structural material, has not found extensive use in this application because of the poor properties of the material at room temperature.

It is known that tri-nickel aluminide has good physical properties at temperatures above 1000° F. and could be employed, for example, in jet engines as component parts at operating or higher temperatures. However, if the material does not have favorable properties at room temperature and below the part formed of the aluminide may break when subjected to stress at the lower temperatures at which the part would be maintained prior to starting the engine and prior to operating the engine at the higher temperatures.

Alloys having a tri-nickel aluminide base are among the group of alloys known as heat-resisting alloys or superalloys. These alloys are intended for very high temperature service where relatively high stresses such as tensile, thermal, vibratory and shock stresses are encountered and where oxidation resistance is frequently required.

Accordingly, what has been sought in the field of superalloys is an alloy composition which displays favorable stress resistant properties not only at the elevated temperatures at which it may be used, as for example in a jet engine, but also a practical and desirable and useful set of properties at the lower temperatures to which the engine is subjected in storage and mounting and starting operations. For example, it is well known that an engine may be subjected to severe subfreezing temperatures while standing on an airfield or runway prior to starting the engine.

Significant efforts have been made toward producing a tri-nickel aluminide and similar superalloys which may be useful over such a wide range of temperature and adapted to withstand the stress to which the articles made from the material may be subjected in normal operations over such a wide range of temperatures.

For example, U.S. Pat. No. 4,478,791, assigned to the same assignee as the subject application, teaches a method by which a significant measure of ductility can be imparted to a tri-nickel aluminide base metal at room temperature to overcome the brittleness of this material.

Also, copending applications of the same inventors as the subject application, Ser. Nos. 647,326; 647,327; 647;328; 646,877 and 646,879 filed Sept. 4, 1984 teach methods by which the composition and methods of the U.S. Pat. No. 4,478,791 may be further improved. These applications are incorporated herein by reference.

For the unmodified binary intermetallic, there are many reports in the literature of a strong dependence of strength and hardness on compositional deviations from stoichiometry. E. M. Grala in "Mechanical Properties of Intermetallic Compounds", Ed. J. H. Westbrook, John Wiley, New York (1960), p. 358, found a significant improvement in the room temperature yield and tensile strength in going from the stoichiometric compound to an aluminum-rich alloy. Using hot hardness testing on a wider range of aluminum compositions, Guard and Westbrook found that at low homologous temperatures, the hardness reached a minimum near the stoichiometric composition, while at high homologous temperature the hardness peaked at the 3:1 Ni:Al ratio. Trans. TMS-AIME 215 (1959) 807. Compression tests conducted by Lopez and Hancock confirmed these trends and also showed that the effect is much stronger for Al-rich deviations than for Ni-rich deviations from stoichiometry. Phys. Stat. Sol. A2 (1970) 469. A review by Rawlings and Staton-Bevan concluded that in comparison with Ni-rich stoichiometric deviations, Al-rich deviations increase not only the ambient temperature flow stress to a greater extent, but also that the yield stress-temperature gradient is greater. J. Mat. Sci. 10 (1975) 505. Extensive studies by Aoki and Izumi report similar trends. Phys. Stat. Sol. A32 (1975) 657 and Phys. Stat. Sol. A38 (1976) 587. Similar studies by Noguchi, Oya and Suzuka also reported similar trends. Met. Trans. 12A (1981) 1647.

More recently, an article by C. T. Liu, C. L. White, C. C. Koch and E. H. Lee appearing in the "Proceedings of the Electrochemical Society on High Temperature Materials", ed. Marvin Cubicciotti, Vol. 83-7, Electrochemical Society, Inc. (1983). p. 32. discloses that the boron induced ductilization of the same alloy system is successful only for aluminum lean $Ni_3Al$.

Another article dealing with tri-nickel aluminide is one by C. T. Liu and C. C. Koch, "Development of Ductile Polycrystalline $Ni_3Al$ For High Temperature Applications", Technical Aspects of Critical Materials Use by the Steel Industry, NBSIR 83-2679-2, Volume IIB, June 1983, Center for Materials Science, U.S. Dept. of Commerce, National Bureau of Standards.

The subject application presents a further improvement in the nickel aluminide to which significant increased ductilization has been imparted.

BRIEF SUMMARY OF THE INVENTION

It is accordingly one object of the present invention to provide a method of forming an article adapted to use in structural parts at room temperature as well as at elevated temperatures of over 1000° F.

Another object is to provide an article suitable for withstanding significant degrees of stress and for providing appreciable ductility at room temperature as well as at elevated temperatures of over 1000° F.

Another object is to provide a consolidated material which can be formed into useful parts having the combination of properties of significant strength and ductility at room temperature and elevated temperatures of over 1000° F.

Another object is to provide a consolidated material which is suitable for cold rolling, extrusion, and isothermal forming, and the like.

Another object is to provide parts consolidated from powder which have a set of properties useful in applications such as jet engines and which may be subjected to a variety of forms of stress.

Other objects will be in part apparent and in part set forth in the description which follows.

In one of its broader aspects an object of the present invention may be achieved by providing a melt having a tri-nickel aluminide base and containing a relatively small percentage of boron. The melt is then atomized by inert gas atomization. The melt is rapidly solidified to powder during the atomization. The material is then consolidated by hot isostatic pressing at a suitable temperature pressure and time, as for example it may be consolidated at a temperature of about 1150° C. and at about 15 ksi for about two hours.

The consolidated part thus formed will have the shape imparted by the container in which it was consolidated. After it is released from the container it can be machined to specific dimensions. If as a result of the machining the part being prepared is subjected to stresses the stresses may be relieved by an anneal. Such an anneal may be at a high temperature ranging from 800° to 1200° C. for about two hours.

Although the melt referred to above should ideally consist only of the atoms of the intermetallic phase and atoms of boron, it is recognized that occasionally and inevitably other atoms of one or more incidental impurity atoms may be present in the melt.

As used herein the expression tri-nickel aluminide base composition refers to a tri-nickel aluminide which contains impurities which are conventionally found in nickel aluminide compositions. It includes as well other constituents and/or substituents which do not detract from the unique set of favorable properties which are achieved through practice of the present invention.

BRIEF DESCRIPTION OF THE DRAWINGS

The invention will be understood with greater clarity from the description which follows by reference to the accompanying drawings in which.

DETAILED DESCRIPTION OF THE INVENTION

Figure 1:
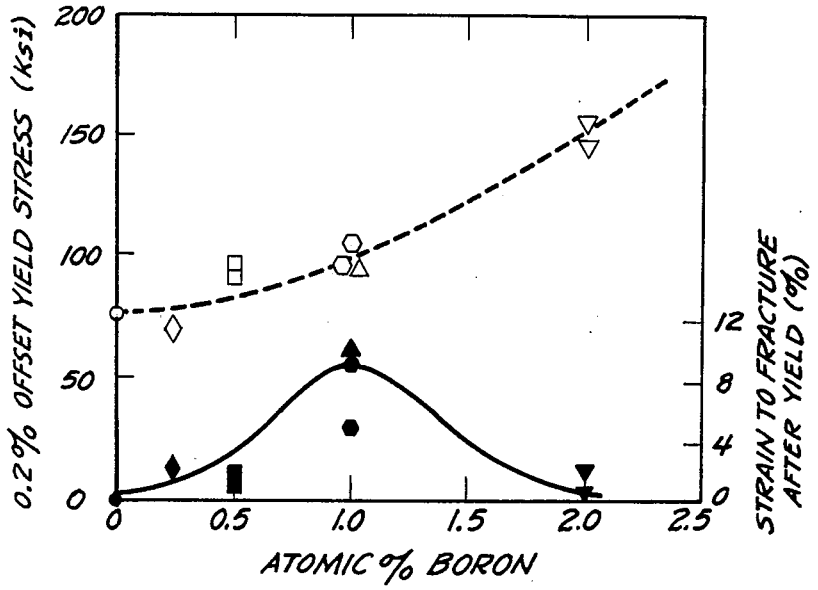
Fig. 1 (PRIOR ART)
FIG. 1 is a prior art graph displaying certain properties of boron doped tri-nickel aluminides.
Figure 2:
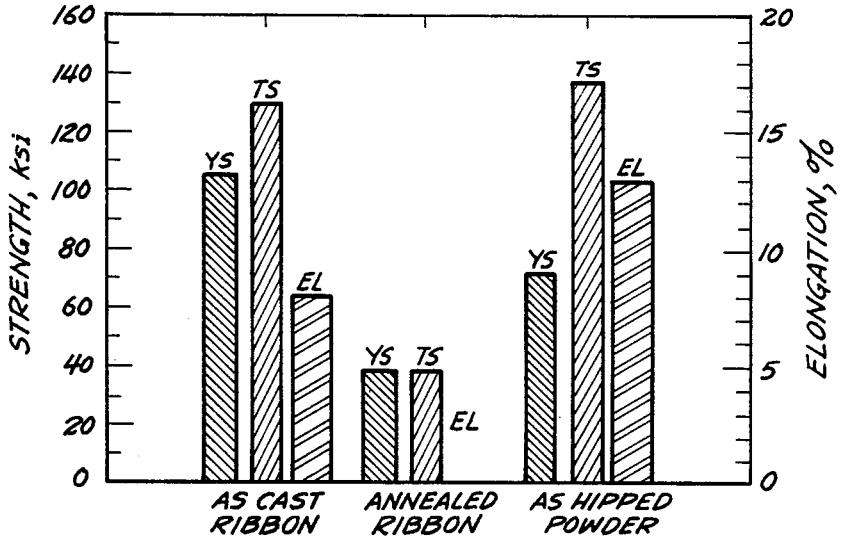
FIG. 2 is a bar graph displaying comparative properties of as cast ribbon, annealed ribbon and HIPped powder of boron doped tri-nickel aluminides.

In the case of the superalloy system $Ni_3Al$ or nickel base superalloy, the ingredient or constituent metals are nickel and aluminum. The metals are present in the stoichiometric atomic ratio of 3 nickel atoms for each aluminum atom in this system.

A nickel aluminide base metal of this invention may also have some substituent metals present such as are taught in the copending applications referenced above.

Nickel aluminide is found in the nickel-aluminum binary system and as the gamma prime phase of conventional gamma/gamma prime ($\gamma/\gamma'$) nickel-base superalloys. Nickel aluminide has high hardness and is stable and resistant to oxidation and corrosion at elevated temperatures of over 1000° F. which makes it attractive as a potential structural material.

Nickel aluminide, which has a face centered cubic (FCC) crystal structure of the $Cu_3Al$ type ($L1_2$ in the Stukturbericht designation which is the designation used herein and in the appended claims) with a lattice parameter $a_o=3.589$ at 75 at. % Ni and melts in the range of from about 1385° to 1395° C., is formed from aluminum and nickel which have melting points of 660° and 1453° C., respectively. Although frequently referred to as $Ni_3Al$, nickel aluminide is an intermetallic phase and not a compound as it exists over a range of compositions as a function of temperature, e.g., about 72.5 to 77 at. % Ni (85.1 to 87.8 wt. %) at 600° C.

Polycrystalline $Ni_3Al$ is quite brittle and shatters under stress as applied in efforts to form the material into useful objects or to use such an article.

It was discovered that the inclusion of boron in the rapidly cooled and solidified alloy system can impart desirable ductility to the rapidly solidified alloy as taught in U.S. Pat. No. 4,478,791.

The alloy compositions of the prior and also of the present invention must also contain boron as a tertiary ingredient as taught herein and as taught in U.S. Pat. No. 4,478,791. A preferred range for the boron tertiary addition is between 0.5 and 1.5 atomic percent.

By the prior teaching of U.S. Pat. No. 4,478,791, it was found that the optimum boron addition was in the range of 1 atomic percent and permitted a yield strength value at room temperature of about 100 ksi to be achieved for the rapidly solidified product. The fracture strain of such a product was about 10% at room temperature.

The composition which is formed must have a preselected intermetallic phase having a crystal structure of the $L1_2$ type and must have been formed by cooling a melt at a cooling rate of at least about $10^3$° C. per second to form a solid body the principal phase of which is of the $L1_2$ type crystal structure in either its ordered or disordered state. The melt composition from which the structure is formed must have the first constituent and second constituent, including the respective substituents, present in the melt in an atomic ratio of approximately 3:1.

In the practice of this invention, an intermetallic phase having an $L1_2$ type crystal structure is important. It is achieved in alloys of this invention as a result of rapid solidification. It is important that the $L1_2$ type crystal structure be preserved in the products which are annealed for consolidation after rapid solidification.

By the inert gas atomization the melt is rapidly cooled at a rate in excess of $10^3$° C./sec. to form solid particle bodies the principal phase of which is of the $L1_2$ type crystal structure in either its ordered or disordered state. Thus, although the rapidly solidified solid bodies will principally have the same crystal structure as the preselected intermetallic phase, i.e., the $L1_2$ type, the presence of other phases, e.g., borides, is possible. Since the cooling rates are high, it is also possible that the crystal structure of the rapidly solidified solid will be disordered, i.e., the atoms will be located at random sites on the crystal lattice instead of at specific periodic positions on the crystal lattice as is the case with ordered solid solutions.

The invention and the advantages made possible by the invention will be made clearer by reference to the following examples.

Examples I and II of this application are essentially the Examples I and II of U.S. Pat. No. 4,478,791. They provide reference examples of preparation of rapidly solidified ribbon by a chill block melt spinning process. The examples are as follows:

EXAMPLE I

A heat of composition corresponding to about 3 atomic parts nickel to 1 atomic part aluminum was prepared, comminuted, and about 60 grams of the pieces were delivered into an alumina crucible of a chill-block melt spinning apparatus. The crucible terminated in a flat-bottomed exit section having a slot 0.25 (6.35 mm) inches by 25 mils (0.635 mm) therethrough. A chill block, in the form of a wheel having faces 10 inches (25.4 cm) in diameter with a thickness (rim) of 1.5 inches (3.8). made of H-12 tool steel, was oriented vertically so that the rim surface could be used as the casting (chill) surface when the wheel was rotated about a horizontal axis passing through the centers of and perpendicular to the wheel faces. The crucible was placed in a vertically up orientation and brought to within about 1.2 to 1.6 mils (30–40$\mu$) of the casting surface with the 0.25 inch length dimension of the slot oriented perpendicular to the direction of rotation of the wheel.

The wheel was rotated at 1200 rpm, the melt was heated to between about 1350° C. and 1450° C. and ejected as a rectangular stream onto the rotating chill surface under the pressure of argon at about 1.5 psi to produce a long ribbon which measured from about 40–70$\mu$ in thickness by about 0.25 inches in width.

EXAMPLE II

The procedure of Example I was repeated using the same equipment 5 more times using master heats of the nominal $Ni_3Al$ composition modified with 0.25, 0.50, 1.0 and 2.0 at. % boron (heats X081982-1, X081782-2, X082482-1 and X082582-1) and a second heat at 1.0 at. % boron (heat X101182-1).

The completed ribbons were tested in tension without any preparation. The resulting 0.2% offset yield strength (0.2% flow stress) and strain to failure after yield (i.e., total plastic strain), $\epsilon_p$ are shown in FIG. 1 as a function of atomic percent boron. The total plastic strains reported in FIG. 1 should be regarded as minimum material properties since the thin ribbons are largely susceptible to premature failure induced by surface defects. Thus, the total plastic strain (ductility) would be expected to be much higher for bulk material in which surface defects will play a much less influential role. In fact, although not done for the ribbons of Examples I and II, the apparent ductility of ribbon-like specimens can generally be increased by mechanically polishing either the flat width surfaces or the edges, or both, to remove surface and near-surface defects and asperities.

As has also been brought out in U.S. Pat. No. 4,478,791 ribbon articles prepared as described in Example II have offset yield stress values of about 100 ksi and have strain to fracture after yield values in percent of about 10% where the rapidly solidified ribbon specimen contains about 1 at. % boron.

As is evident from prior art FIG. 1, this is an optimum combination of values inasmuch as the yield stress value continues to rise as the percent of boron is increased but the strain to fracture after yield in percent values drop off as the percent of boron is increased in accordance with the values set forth in the abscissa of FIG. 1.

Accordingly for comparison's sake, a sample of a tri-nickel aluminide base alloy is preferably prepared with about a 1% boron content to provide a basis for comparing properties with the values displayed for the ribbon product as disclosed in U.S. Pat. No. 4,478,791 and as displayed in prior art FIG. 1 which accompanies this specification.

EXAMPLE III

A sample of ribbon prepared as described in Example II containing approximately 1 at. % of boron was heated at 1100° C. The 1100° C. temperature was chosen because this is the temperature at which material such as a tri-nickel aluminide is conventionally consolidated in order to permit a part to be formed of the ribbon starting material.

It was discovered that the ductile ribbons prepared as described in Example II become brittle when subjected to high temperature as, for example, the 1100° C. anneal of this Example.

Based on this finding a conclusion is reached that annealing embrittlement of the ribbon product as prepared in Example II effectively precludes the preparation of large scale articles for engineering type applications. Accordingly while the preparation of the ribbon material is unique and produces a unique result and finding, the transformation of the unique ductile ribbon into large scale parts by consolidation does not appear to be practical.

EXAMPLE IV

A 10 pound heat of boron doped tri-nickel aluminide containing approximately 0.93% boron was prepared by vacuum induction melting.

The ingot so prepared had a composition as follows:

$$(Ni_{0.75}Al_{0.25})_{99.07}B_{0.93}$$

The ingot was remelted in vacuum and it was atomized into powder in an argon atmosphere. The atomization was carried out by a process as taught in copending applications of S. A. Miller, Ser. Nos. 584,687; 584,688; 584,689; 584,690 and 584,691 assigned to the assignee of the subject application. The text of these applications is incorporated herein by reference. Other and conventional gas atomization processes which result in the rapid solidification of the powder product may be employed to form rapidly solidified powder for consolidation pursuant to the present invention.

The powder was collected and the collected powder was sieved to separate fractions of the powder according to mesh sizes. Only those powders whose size is less than −100 mesh were separated for use in the subject example. The sample of powder having particle sizes of less than −100 mesh were blended and introduced into a high temperature isostatic pressing container, also referred to as a HIP container. The container is a conventional container for high temperature isostatic pressing, which is more commonly referred to as HIPping. The container which incorporated the powder was evacuated before being hermetically sealed. It was then subjected to hot isostatic pressing at about 1165° C. at a pressure of about 15 ksi for a period of about 4 hours.

Following the HIPping the container was removed from around the sample and the sample was subjected to metallographic examination. From this examination it was found that the consolidated powder appeared to have a completely dense microstructure.

Tests were conducted on samples respectively of as-cast ribbon, annealed ribbon and of the HIPped article prepared according to this example.

The tests were of the yield strength, tensile strength and elongation.

The tests performed were the same as the tests performed on the samples of ribbon prepared as described in Examples II and III. The results of the tests of the samples from each example are listed in Table I. The annealed ribbon failed during elastic loading.

TABLE I

Tensile and Ductility Property Comparison between $Ni_3Al$—B Ribbon and HIPped Powder after Different Thermal Treatments

| FORM | THERMAL TREATMENT | Y.S. (ksi) | T.S. (ksi) | El. (%) |
|---|---|---|---|---|
| ribbon | as-cast | 105 | 130 | 8 |
| ribbon | Annealed 1100° C./2 hrs | (38) | 38 | 0 |
| powder | as HIPped | 72 | 138 | 13 |

From the test results listed in Table I it is evident that the heat treatment of the as-cast ribbon at 1100° C. for 2 hours leads to a severe reduction in strength and also essentially eliminates any ductility.

By contrast a two hour HIPped treatment of powder at 1165° C. while pressing at 15 ksi results in an article which has a ductility which is substantially higher than that of the as-cast ribbon. This result is quite surprising and unexpected.

In addition the strength of the HIPped sample of Example IV is quite good and compares favorably with that of the as cast ribbon.

It will be understood that the HIP process produces consolidated articles which are of different configurations based on the configuration of the container in which the HIP process is carried out. Accordingly it is feasible to prepare parts by the method of the present invention by providing a HIP container of desired shape and by filling the container with the rapidly solidified powder of the boron doped tri-nickel aluminide base alloy followed by sealing of the container and a high pressure high temperature isostatic pressing.

For example a cylindrical tri-nickel aluminide article can be prepared in this fashion. Also a disk or a rod can be prepared through use of a suitably shaped container.

A disk article can be prepared to approximate dimensions by the HIP process and can be machined to final dimensions for use, for example, as a component part of a jet engine.

Where machining to final dimensions has been carried out it may be desirable to anneal the machined part to relieve any stresses which may be imparted to the part by the machinery. An anneal for about 2 hours at a temperature of about 800° C. to about 1200° C. will generally be suitable for this purpose.

What is claimed and sought to be protected by Letters Patent of the United States is as follows:

1. A method of producing an article of a tri-nickel aluminide base alloy of improved strength and ductility which comprises, forming a melt of the boron doped tri-nickel aluminide of the following base composition $$(Ni_{1-x}Al_x)_{100-y}B_y$$

where x is between 0.23 and 0.25, and where y is 0.1 to 2.0, rapidly solidifying the melt by gas atomization of the melt to fine particles, and consolidating the particles so produced by hot isostatic pressing for a time and at a temperature above 1000° C., and a pressure above 15 ksi to form a dense article.

2. The method of claim 1 wherein the consolidated particles are −100 mesh.

3. The method of claim 1 wherein the consolidating temperature is between 1000° and 1200° C.

4. The method of claim 1 wherein the consolidating temperature is about 1165° C.

5. The method of claim 1 wherein the boron content is about 1.0 atom percent.

6. An article having high tensile strength and elongation properties at temperatures of over 1000° C. which comprises a body of particles consolidated to a coherent structure, said particles having a $L1_2$ crystalline structure, said particles having a boron doped tri-nickel aluminide base composition according to the formula $$(Ni_{1-x}Al_x)_{100-y}B_y$$

where x is between 0.23 and 0.25, and where y is between 0.1 and 2.0 and said body having tensile strength greater than about 135 ksi and an elongation greater than about 10%.

7. The article of claim 6 in which the boron content y is between 0.5 and 1.5.

8. A method of producing an article of a tri-nickel aluminide base alloy of improved strength and ductility which comprises, forming a melt of the boron doped tri-nickel aluminide of the following base composition $$(Ni_{1-x}Al_x)_{100-y}B_y$$

where x is between 0.23 and 0.25, and where y is 0.1 to 2.0, rapidly solidifying the melt by gas atomization of the melt to fine particles, and consolidating the particles so produced.

* * * * *